US011066967B2

(12) United States Patent
Pawellek

(10) Patent No.: US 11,066,967 B2
(45) Date of Patent: Jul. 20, 2021

(54) CONTROLLABLE LUBRICATING OIL DELIVERY SYSTEM FOR INTERNAL COMBUSTION ENGINES

(71) Applicant: NIDEC GPM GMBH, Auengrund OT Merbelsrod (DE)

(72) Inventor: Franz Pawellek, Lautertal (DE)

(73) Assignee: NIDEC GPM GMBH, Auengrund OT Merbelsrod (DE)

( * ) Notice: Subject to any disclaimer, the term of this patent is extended or adjusted under 35 U.S.C. 154(b) by 0 days.

(21) Appl. No.: 17/044,897

(22) PCT Filed: Apr. 23, 2019

(86) PCT No.: PCT/EP2019/060282
§ 371 (c)(1),
(2) Date: Oct. 2, 2020

(87) PCT Pub. No.: WO2019/206857
PCT Pub. Date: Oct. 31, 2019

(65) Prior Publication Data

US 2021/0148259 A1 May 20, 2021

(30) Foreign Application Priority Data

Apr. 24, 2018 (DE) ..... 10 2018 109 866.9

(51) Int. Cl.
*F01M 1/02* (2006.01)
*F01M 1/16* (2006.01)
*F01M 1/12* (2006.01)
*F04C 14/24* (2006.01)

(52) U.S. Cl.
CPC ..... *F01M 1/16* (2013.01); *F01M 1/02* (2013.01); *F01M 2001/023* (2013.01);
(Continued)

(58) Field of Classification Search
CPC ..... F04C 18/16; F04C 14/24; F04C 27/009; F01M 11/0004
(Continued)

(56) References Cited

U.S. PATENT DOCUMENTS 4,248,293 A 2/1981 Kamezaki et al.
4,525,129 A * 6/1985 Berges ..... F04C 27/02 417/281
(Continued)

FOREIGN PATENT DOCUMENTS

DE 504283 C 8/1930
DE 3840909 A1 6/1989
(Continued)

OTHER PUBLICATIONS

English translation of the International Preliminary Report on Patentability, issued in PCT/EP2019/060282, dated Nov. 5, 2020; ISA/EP.
(Continued)

*Primary Examiner* — Long T Tran
*Assistant Examiner* — James J Kim
(74) *Attorney, Agent, or Firm* — Harness, Dickey & Pierce, P.L.C.

(57) ABSTRACT

An adjustable lubrication oil conveying system for a combustion engine is proposed which comprises a screw pump for conveying lubrication oil with at least one screw rotatably accommodated in a screw chamber, wherein the screw pump is arranged such that a suction side of the screw chamber is connected with an intake path from an oil sump of the combustion engine, and a pressure side of the screw chamber is connected with a feed path to moving parts of the combustion engine. The lubrication oil conveying system is characterised in particular in that the screw pump is driven by the combustion engine; and towards the suction side of
(Continued)

the screw chamber, an adjustable throttle valve is provided by means of which a flow cross-section of the intake path is gradually limitable between an opened position and a closed position. Therefore, the oil pressure in a combustion engine is, for the first time, adjusted by suction throttling in connection with a screw pump.

8 Claims, 1 Drawing Sheet

(52) U.S. Cl.
CPC ..... *F01M 2001/123* (2013.01); *F04C 14/24* (2013.01); *F04C 2210/206* (2013.01)

(58) Field of Classification Search
USPC ..... 123/196 R
See application file for complete search history.

(56) References Cited

U.S. PATENT DOCUMENTS 4,586,468 A * 5/1986 Dzioba ..... B60T 17/02 123/198 C
2003/0147764 A1* 8/2003 Kreihn ..... F16H 57/0415 418/88
2006/0222553 A1* 10/2006 Scholz ..... F04C 29/02 418/201.1
2019/0301591 A1* 10/2019 Pritchard ..... F16H 57/0473

FOREIGN PATENT DOCUMENTS

DE 102005029084 A1 12/2006
DE 102009056218 A1 6/2011
DE 102013102031 A1 9/2014
DE 102014209301 A1 11/2015
GB 2432631 A 5/2007
WO WO-02093013 A1 11/2002

OTHER PUBLICATIONS

International Search Report and Written Opinion of the International Searching Authority, issued in PCT/EP2019/060282, dated Jul. 22, 2019; ISA/EP.

* cited by examiner

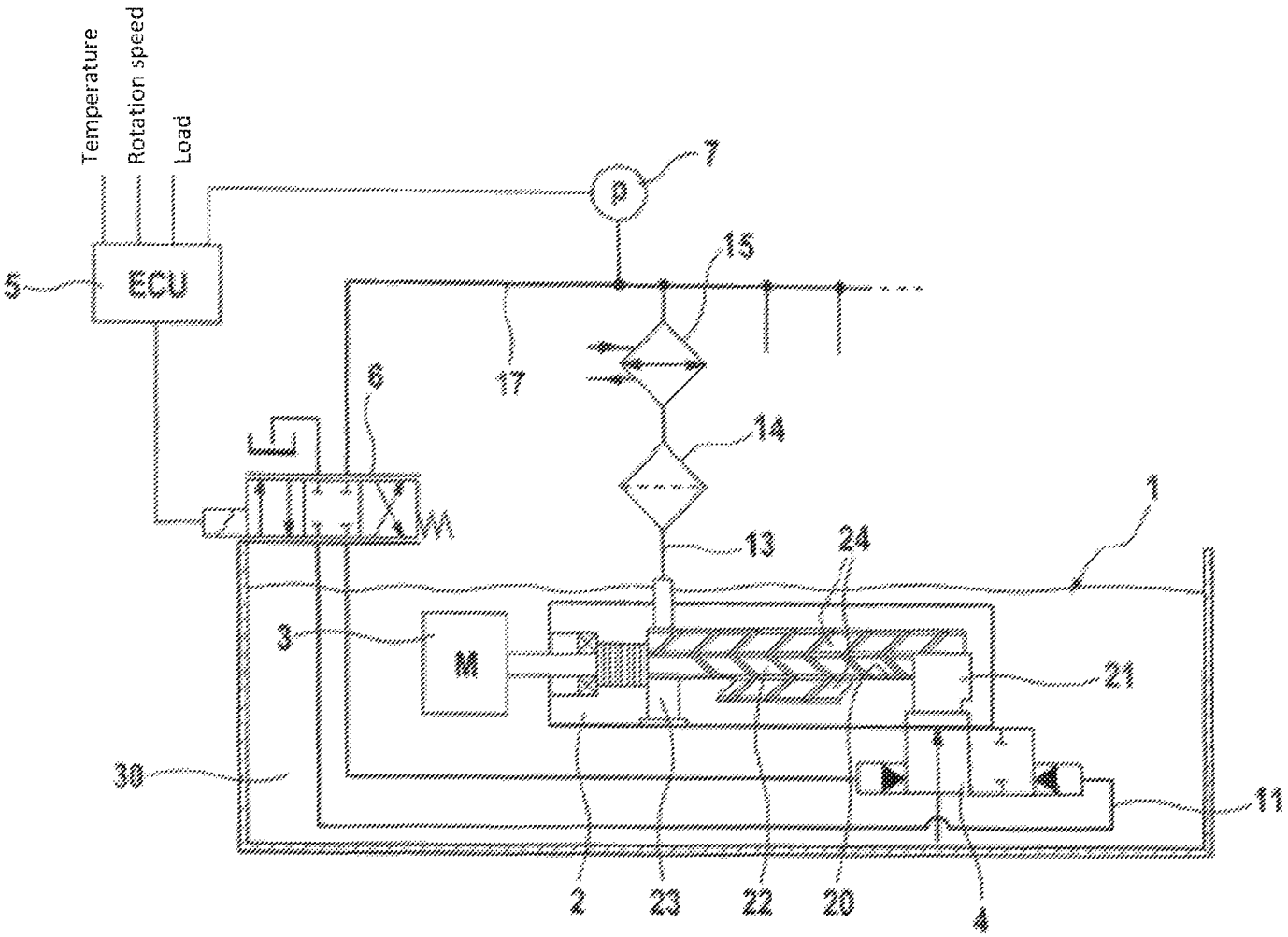
ECU
Temperature
Rotation speed
Load
5
7
15
17
14
13
6
M
3
1
24
21
11
4
20
22
23
2
30

CONTROLLABLE LUBRICATING OIL DELIVERY SYSTEM FOR INTERNAL COMBUSTION ENGINES

CROSS-REFERENCE TO RELATED APPLICATIONS

This application is a U.S. National Phase Application under 35 U.S.C. 371 of International Application No. PCT/EP2019/060282, filed on Apr. 23, 2019, which claims the benefit of German Patent Application No. 10 2018 109 866.9, filed on Apr. 24, 2018. The entire disclosures of the above applications are incorporated herein by reference.

The present invention relates to an adjustable lubrication oil conveying system for combustion engines, in particular those used in utility vehicles, or for combustion engines in applications which have an increased demand for long-term loading as well as safeguarding against failure and for service life.

For large volume combustion engines in ships or even in trucks, the use of screw pumps as oil pumps for the supply of lubrication oil is known, these being directly mechanically driven by an output shaft of the combustion engine. Screw pumps are displacement pumps, the displacement volume of which is in a fixed relation to a shaft rotation or pump rotation speed, they are fixed displacement pumps with an unchanging pump geometry and they achieve high delivery pressures. In addition, they have a high power density, whereby they can achieve high delivery pressures in relation to a supply of lubrication oil.

The structure of screw pumps comprises no delicate elements or sliding fits, whereby, even with long intervals between maintenance, the type of pump is relatively insensitive to becoming soiled with soot or metal abrasions in the lubrication oil. On the other hand, the structure is of a larger axial dimension compared with a vane pump or a geared pump.

These latter displacement pumps offer a smaller axial dimension and, in known variations of a variable pump geometry, also the possibility of changing the displacement volume in relation to the shaft rotation, whereby advantages are achieved especially in relation to applications with widely varying rotation speeds, such as in particular in operation of smaller combustion engines in passenger cars. However, vane pumps and geared pumps generally achieve lower pressures, are more sensitive and have a shorter service life than screw pumps.

If a screw pump used as an oil pump is dimensioned to a size sufficiently robust for long-term operation, the achieved delivery pressures exceed a permissible operating range for the oil pressure in the combustion engine in the case of a rapid increase in rotation speed and at high rotation speeds. Otherwise, the supply pressure can exceed at least an oil pressure required according to the operating load, whereby efficiency of the driving power or of the fuel consumption and the emission values and service life of seals are adversely affected.

With respect to the achievement of reliable and long-lasting conveying of lubrication oil for a combustion engine with a high level of long-term loading, which exploits the advantages of the robust construction of the pump as a screw pump, the problem therefore arises of providing for adjustment of the displacement volume of this fixed displacement pump type in order to permit adjustment of the oil pressure in the combustion engine as required, independently of the predefined rotation speed.

Thus, in the prior art, purely electric or electrically-assisted drive variations of a screw pump have already been proposed in order to carry out an adjustment of the displacement volume with the aid of the pump rotation speed. Thus DE 25 56 948 A1 describes a screw pump with its own electric motor independent of the combustion engine.

DE 10 2014 209 301 A1 describes an electric/mechanical hybrid drive for a screw pump. By means of an electric motor on the one hand and an output shaft of the combustion engine on the other hand, and via a summation gear or an overriding drive in the form of a planetary gear, control of the pump rotation speed is implemented for a power input of the screw pump as required.

However, the service life of an additional electric drive, which is subject to long-term loading and the external influences of use, stands in the way of achieving a robust, low-maintenance lubrication oil conveying system. Furthermore, the integration of the additional electric drive increases the complexity and costs of the system.

Alternatively, in the prior art, a hydraulic adjustment of the displacement volume of a screw pump has been proposed in which a recirculation of some of the displacement volume can be adjusted, this flowing through the screw pump again, whereby the resulting delivery stream in the lubrication oil conveying system is reduced.

In this regard DE 10 2009 056 218 A1 describes a screw pump on which a pressure-limiting valve with a return path is integrated, whereby, above a set delivery pressure, a hydraulic short-circuit is produced between the pressure side and suction side of the pump.

DE 504 283 A1 discloses a manually adjustable regulating device for a screw pump which serves as an oil pump on a combustion engine. For this purpose, two pressure-side pump outlets from the pumping chamber are provided for the delivery circuit and the return path between the pressure side and suction side, wherein an adjustable valve is provided in the return path. Therefore, under partial loading, the oil pressure is reduced in that the effective displacement volume is reduced by a recirculating portion. However, the introduced driving power remains the same or in a fixed relation to the predefined rotation speed.

It is an object of the invention to provide an alternative lubrication oil conveying system with a screw pump, which permits adjustment of the oil pressure of the driving combustion engine as required.

The object is achieved by an adjustable lubrication oil conveying system for a combustion engine having the features of claim 1.

The adjustable lubrication oil conveying system is characterised in particular in that a screw pump is driven by the combustion engine; and towards the suction side of the screw chamber, an adjustable throttle valve is provided by means of which a flow cross-section of the intake path is gradually limitable between an opened position and a closed position.

Therefore, the invention provides, for the first time, upstream suction throttling on a screw pump in order to adjust the delivery pressure, i.e. in particular the oil pressure in a lubrication oil supply of a combustion engine.

In contrast to through-flow limitation downstream of a displacement pump, which produces a corresponding flow resistance on the pressure side, or a recirculation, which produces a corresponding portion of reactive power in a delivery power, in the case of suction throttling, the required driving power decreases together with the effective delivery power. Therefore, an applied driving power in an operating range of decreased supply pressure is reduced and amongst the advantages of having a durable type of pump the efficiency of the lubrication oil conveying system is improved.

In the conveyed medium, in particular in the present case of a lubrication oil, suction throttling causes splitting into a liquid phase and a gaseous phase, as explained below. In contrast to a vane pump or a geared pump, the screw pump is suitable for the delivery of two-phase media owing to the robust construction and long extent of the sealing gap of the screw.

In the case of such suction throttling, a pressure downstream of the throttle valve and upstream of a pump inlet is reduced towards the negative pressure of the suction side of the pump chamber or of the screw chamber. In this way, at the same time, a pressure difference which is required to fill the screw chamber within a rotation speed-dependant time is reduced and ideally no longer reached. Consequently, the constant displacement volume in the screw chamber contains a liquid phase and a dissolved gaseous phase at a negative pressure.

The gaseous phase is formed of dissolved air or other dissolved components of the lubrication oil which, at the interim negative pressure, are expanded in a volatile manner out of the liquid phase and, after an increase in pressure towards the pressure side of the screw chamber, are condensed into the liquid phase as a dissolved component. Owing to the two-phase state, the displacement volume measured with respect to the liquid phase, and the supply pressure at the same rotation speed decrease.

During suction throttling, together with the supply pressure, a driving power to be applied at the same rotation speed also decreases in spite of a portion of performed physical work in order to dissolve the gaseous phase at negative pressure. In this application, over a majority of the operating duration of the combustion engine, a partial load is present in relation to a maximum provided working load and therefore a corresponding throttling of the required oil pressure. Therefore, over the majority of the operating duration, a more efficient transfer of the driving power to the lubrication oil conveying system, or a saving on fuel is achieved.

Advantageous embodiments of the adjustable lubrication oil conveying system are the subject-matter of the dependent claims.

According to one aspect of the invention, the lubrication oil conveying system can further comprise a pressure sensor, which detects a supply pressure of the lubrication oil in the lubrication oil conveying system, and a control device which receives the detected supply pressure of the lubrication oil and which is configured to adjust the supply pressure of the lubrication oil by driving the throttle valve.

By means of the control device, an adjustment path for controlling the throttle valve is provided, and an adjustment function for the supply pressure of the adjustable lubrication oil conveying system or the oil pressure in the combustion engine is rendered possible.

According to one aspect of the invention, the control device can further receive a rotation speed of the combustion engine that is detected by a rotation speed sensor, and can be configured to adjust the supply pressure of the lubrication oil depending on the rotation speed of the combustion engine.

Therefore, feedback relating to the rotation speed of the combustion engine is produced as an input parameter for the adjustment of the oil pressure in the combustion engine.

According to one aspect of the invention, the control device can further receive a load of the combustion engine that is detected by a torque sensor, and can be configured to adjust the supply pressure of the lubrication oil depending on the load of the combustion engine.

Therefore, feedback relating to the load of the combustion engine is produced as an input parameter for the adjustment of the oil pressure in the combustion engine.

According to one aspect of the invention, the control device can further receive a temperature of the combustion engine that is detected by a temperature sensor, and can be configured to adjust the supply pressure of the lubrication oil depending on the temperature of the lubrication oil or the combustion engine.

Therefore, feedback relating to the oil temperature in the combustion engine, which is also interrelated to the viscosity of the lubrication oil, is produced as an input parameter for the adjustment of the oil pressure in the combustion engine.

According to one aspect of the invention, the feed path can comprise a control branch for feeding a hydraulic control pressure, and the throttle valve can comprise a hydraulic actuator for receiving the hydraulic control pressure.

By means of this design, a hydraulic variation for actuating the throttle valve is created which is less sensitive in particular in the environmental influences of the oil sump, i.e. in an immersion bath arrangement, and allows a longer service life.

According to one aspect of the invention, the lubrication oil conveying system can further comprise an electric/hydraulic regulating device hydraulically connected with the intake path and the feed path and electrically connected with the control device, and the electric/hydraulic regulating device can be configured to drive the throttle valve depending on a pressure ratio between the intake path and the feed path as well as an output control value of the control device.

Alternatively to an electromotive actuation of the throttle valve by a stepping motor, durable hydraulic actuating elements and adjustment or partial adjustment are provided which ensure a fail-safe setting or adjustment even in the case of an electrical malfunction.

According to one aspect of the invention, the electric/hydraulic regulating device can be provided in the form of an electromagnetic 4/3 proportional valve which is driven by a pulse width modulation of the control device.

Therefore, the discussed advantages of the electric/hydraulic regulating device can be achieved by the use of a standardised component.

The invention will be explained hereinafter based on an embodiment and with reference to the accompanying drawing, in which:

FIG. 1 is a schematic block diagram of the adjustable lubrication oil conveying system in accordance with the invention, which is disposed in a combustion engine and comprises a control device.

As shown in the block diagram of FIG. 1, the lubrication oil conveying system 1 comprises a screw pump 2 and a throttle valve 4 which are disposed in an oil sump 30. The oil sump 30 is formed by collected lubrication oil which is received in an oil pan of a schematically illustrated combustion engine 3 (M).

In terms of this disclosure, the term 'screw pump' 2 is understood to mean rotary piston pumps with a thread pitch for displacement of the conveyed medium in the delivery direction. Such pump types comprise at least one driven screw and can also comprise rotatable screw shafts which are in coupled motion with thread toothing.

The screw pump 2 of the present embodiment comprises a screw 22 which is rotatably received in a screw chamber 20 of a pump housing. The screw 22 is driven by a crank shaft of the combustion engine 3 and is in engagement with two rotatably mounted screw shafts 24 of different lengths. On a drive side of the screw 22 is located a pressure side 23 of the screw chamber 20 and at another end of the screw 22 is located a suction side 21 of the screw chamber 20. In a delivery direction produced by a screw pitch of the rotating screw 22, lubrication oil is taken into the screw chamber 20 by a negative pressure on the suction side 21, conveyed along the screw 22 and the screw shafts through the screw chamber 20 and ejected out of the screw chamber 20 on the pressure side 23.

The suction side 21 of the screw chamber 21 is connected to an intake path 11 which feeds lubrication oil out of the oil sump 30. The throttle valve 4 is disposed between the suction side 21 of the screw chamber 21 and the intake path 11. The throttle valve 4 allows an adjustment of the flow cross-section through which the screw pump 2 takes in lubrication oil from of the oil sump 30. The throttle valve 4 comprises a hydraulic actuator, i.e. an adjustment of the flow cross-section takes place via a hydraulic control pressure which is applied to a hydraulic control connection of the throttle valve 4, as explained hereinunder.

The pressure side 23 of the screw chamber 20 is connected to a feed path 13 of the lubrication oil conveying system 1. The feed path 13 leads to branches of a lubrication oil supply, not illustrated, such as an oil gate, of the combustion engine 3 which serves to lubricate sliding surfaces between moving parts in a crank drive, a valve drive and cylinder running tracks and the like with an oil pressure, corresponding to the delivery supply, in the combustion engine 3. An oil filter 14 and an oil cooler 15 are also disposed in the feed path 13. The feed path 13 further comprises a hydraulic control branch 17 in which a pressure sensor 7 (P) is disposed. The hydraulic control branch 17 leads via an electric-hydraulic regulating device 6 to the hydraulic control connection of the throttle valve 4.

The electric-hydraulic regulating device 6 comprises a 4/3 proportional valve, the four hydraulic connections of which are connected to the intake path 11 and the hydraulic control branch 17. Between the two connections to the hydraulic control branch 17, an adjustable hydraulic resistance to the setting of a pressure difference between the two connections of the control branch 17 is provided by means of a valve body. The electric-hydraulic regulating device 6 further comprises an electromagnetic actuator with a coil and an armature and a compression spring. On the one hand, a control force from a pressure difference between the intake path 11 and the hydraulic control branch 17 and, on the other hand, a control force of an equilibrium between the compression spring and the electromagnetic actuator act on the valve body of the electric-hydraulic regulating device 6.

The electromagnetic actuator of the electric-hydraulic regulating device 6 is connected to an electronic control device 5 (ECU) which outputs an electric power supply with a pulse width modulation to drive the electromagnetic actuator. The control device 5 is electrically connected to the pressure sensor 7 in the hydraulic control branch 17. Furthermore, the control device 5 is connected to sensors, not illustrated, in order to receive a load, a rotation speed and a temperature of the combustion engine 3 which are each detected by the sensors at the combustion engine 3.

The control device 5 controls the electromagnetic actuator of the electric-hydraulic regulating device 6 in order to adjust the hydraulic control pressure of the hydraulic control branch 17 at the throttle valve 4 and therefore, via the set flow cross-section in the intake path 11, to adjust the resulting supply pressure in the feed path 13 of the lubrication oil conveying system 1, which is used as the oil pressure for supplying lubrication oil to the moving parts of the combustion engine 3. The pulse width modulation for the driving of the electromagnetic actuator of the electric-hydraulic regulating device 6 is set by the control device 5 in depending on received values which are detected by the sensors.

For example, in the case of an increase in the load or a low temperature of the combustion engine 3, the control device 5 reduces a switch-on duration of the pulse width modulation in order to drive the electromagnetic actuator in the electric-hydraulic regulating device 6. By a reduction in the switch-on of the pulse width modulation, a control force of the electromagnetic actuator is reduced in comparison with the control force of the compression spring on the valve body of the 4/3 proportional valve in the electric-hydraulic regulating device 6, and a pressure reduction of the hydraulic control pressure in the hydraulic control branch 17 is reduced. In this way, the hydraulic control pressure increases, whereby, in the throttle valve 4, a flow cross-section of the intake path 11 is enlarged with respect to the suction side 21 of the screw chamber 20. As a result of the reduced suction throttling, an output pressure on the pressure side 23 of the screw chamber 20 and a resulting supply pressure in the lubrication oil conveying system 11 increase. Consequently, an oil pressure in the combustion engine 3 is increased in the case of an increase in the load or the rotation speed or a low oil temperature and is adjusted in depending on the same.

In the case of a reduction in the load or an increase in the rotation speed which would lead to excessive oil pressure in the combustion engine 3 owing to the proportional increase in the displacement volume or supply pressure of the displacement pump, an inverted adjustment takes place in the adjustment path. Thus, the suction throttling is increased, the supply pressure in the lubrication oil conveying system 1 is reduced and a required driving power of the combustion engine 3 for the lubrication oil conveying system 1 decreases.

A fail-safe mode is also ensured by means of the hydraulic and electrical driving of the throttle valve via the 4/3 proportional valve. In the case of an electrical malfunction, such as a failure in control electronics, a situation can arise in which no electrical power supply with pulse width modulation arrives for the driving of the electromagnetic actuator in the electric-hydraulic regulating device 6. In this case, a force ratio between the control force of the compression spring and a control force from a pressure difference between the intake path 11 and the hydraulic control branch 17 is selected in such a way that substantially no hydraulic resistance to the pressure reduction is exerted on the hydraulic control pressure at the throttle valve 4. Therefore, in the case of such an electrical malfunction, it is ensured that substantially no limitation of the flow cross-section in the intake path 11 is carried out, and the resulting supply pressure in the feed path 13 is not lowered below a required oil pressure of the combustion engine 3, despite a failure of an adjusting function of the control technology. At the same time, the hydraulic driving of the throttle valve 4 from a pressure difference between the intake path 11 and the feed path 13, both during an adjustment and also during an electrical failure, prevents an excessive oil pressure from being able to occur in relation to the rotation speed owing to an unthrottled state of the screw pump 2.

In an alternative embodiment of the lubrication oil conveying system 1, the electric-hydraulic regulating device 6, i.e. a 4/3 proportional valve and the hydraulic control branch 17, can be omitted. In this case, the throttle valve 4 can be adjusted by an electric actuator which is driven directly by the control device 5.

Furthermore, the lubrication oil conveying system can comprise a different configuration in relation to the hydraulic paths such as the lubrication oil supply and the arrangements of integrated devices such as the oil filter 14 and the oil cooler 15. Furthermore, the throttle valve 4, in particular in the case of an electrically actuated variation, can be disposed outside the oil sump 30 as long as the throttle valve is in the intake path 11. Similarly, the screw pump 2 can be disposed outside the oil sump provided it is driven by the combustion engine 3 and is connected to the intake path 11 and the feed path 13.

OVERVIEW OF REFERENCE SIGNS

1 lubrication oil conveying system
2 screw pump
3 combustion engine
4 throttle valve
5 control device
6 electric-hydraulic regulating device
7 pressure sensor
11 intake path
13 feed path
14 oil filter
15 oil cooler
17 hydraulic control branch
20 screw chamber
21 suction side of screw chamber
22 screw
23 pressure side of the screw chamber
24 screw shafts
30 oil sump

The invention claimed is:

1. An adjustable lubrication oil conveying system for a combustion engine comprising:

a screw pump for conveying lubrication oil with at least one screw rotatably accommodated in a screw chamber; wherein the screw pump is arranged such that a suction side of the screw chamber is connected with an intake path from an oil sump of the combustion engine, and a pressure side of the screw chamber is connected with a feed path to moving parts of the combustion engine;

wherein the screw pump is driven by the combustion engine; and towards the suction side of the screw chamber an adjustable throttle valve is provided by means of which a flow cross-section of the intake path is gradually limitable between an opened position and a closed position.

2. The adjustable lubrication oil conveying system according to claim 1, further comprising a pressure sensor that detects a supply pressure of the lubrication oil in the lubrication oil conveying system; and a control device that receives the detected supply pressure of the lubrication oil and that is configured to adjust the supply pressure of the lubrication oil by driving the throttle valve.

3. The adjustable lubrication oil conveying system according to claim 2, wherein the control device further receives a rotation speed of the combustion engine that is detected by a rotation speed sensor, and is configured to adjust the supply pressure of the lubrication oil depending on the rotation speed of the combustion engine.

4. The adjustable lubrication oil conveying system according to claim 2, wherein the control device further receives a load of the combustion engine that is detected by a torque sensor, and is configured to adjust the supply pressure of the lubrication oil depending on the load of the combustion engine.

5. The adjustable lubrication oil conveying system according to claim 2, wherein the control device further receives a temperature of the combustion engine that is detected by a temperature sensor, and is configured to adjust the supply pressure of the lubrication oil depending on the temperature of the combustion engine.

6. The adjustable lubrication oil conveying system according to claim 1, wherein the feed path comprises a control branch for feeding a hydraulic control pressure, and the throttle valve includes a hydraulic actuator for receiving the hydraulic control pressure.

7. The adjustable lubrication oil conveying system according to claim 2, further comprising an electric-hydraulic regulating device hydraulically connected with the intake path and the feed path and electrically connected with the control device, and wherein the electric-hydraulic regulating device is configured to drive the throttle valve depending on a pressure ratio between the intake path and the feed path as well as an output control value of the control device.

8. The adjustable lubrication oil conveying system according to claim 7, wherein the electric-hydraulic regulating device is provided in the form of an electromagnetic 4/3 proportional valve driven by a pulse width modulation of the control device.

* * * * *